US009033616B2

(12) United States Patent
Krumhauer

(10) Patent No.: US 9,033,616 B2
(45) Date of Patent: May 19, 2015

(54) PERSONAL FLOTATION DEVICE FOR A SELF CONTAINED BREATHING APPARATUS

(71) Applicant: Sean Allen Krumhauer, Los Alamitos, CA (US)

(72) Inventor: Sean Allen Krumhauer, Los Alamitos, CA (US)

( * ) Notice: Subject to any disclaimer, the term of this patent is extended or adjusted under 35 U.S.C. 154(b) by 0 days.

(21) Appl. No.: 13/941,462

(22) Filed: Jul. 13, 2013

(65) Prior Publication Data

US 2015/0013673 A1 Jan. 15, 2015

(51) Int. Cl.
*B63C 11/22* (2006.01)
*B63C 11/02* (2006.01)

(52) U.S. Cl.
CPC ..... *B63C 11/2245* (2013.01); *B63C 11/02* (2013.01); *B63C 2011/026* (2013.01)

(58) Field of Classification Search
CPC B63C 9/155; B63C 9/1255; B63C 2011/026; A62B 9/04
USPC ..... 405/186; 441/88–119
See application file for complete search history.

(56) References Cited

U.S. PATENT DOCUMENTS

| | | | | | |
|---|---|---|---|---|---|
| 4,371,353 | A * | 2/1983 | Hume | 441/117 |
| 4,925,418 | A * | 5/1990 | Mariotto nee Amiel | 441/92 |
| 5,702,279 | A * | 12/1997 | Brown | 441/108 |
| 6,106,348 | A * | 8/2000 | Loisel | 441/108 |
| 6,666,622 | B1 * | 12/2003 | Courtney et al. | 405/186 |
| 7,264,525 | B2 * | 9/2007 | Tsitas | 441/98 |
| 7,288,011 | B2 * | 10/2007 | Ganley | 441/106 |
| 7,704,113 | B2 * | 4/2010 | Pele et al. | 441/118 |
| 7,762,252 | B2 * | 7/2010 | Prete | 128/204.18 |
| 8,020,738 | B2 * | 9/2011 | Storey | 224/634 |
| 8,113,198 | B2 * | 2/2012 | Teetzel et al. | 128/205.12 |
| 8,205,775 | B2 * | 6/2012 | Hogg | 224/634 |
| 8,387,844 | B2 * | 3/2013 | Wrigley et al. | 224/614 |

* cited by examiner

*Primary Examiner* — Tara M. Pinnock

(57) ABSTRACT

A lifejacket which is designed to be worn with, alongside, in conjunction with, or integrated within a self contained breathing apparatus.

13 Claims, 3 Drawing Sheets

PERSONAL FLOTATION DEVICE FOR A SELF CONTAINED BREATHING APPARATUS

BACKGROUND OF THE INVENTION

The present device and system is related to self-contained breathing apparatuses, and more particularly to safety systems for users of self-contained breathing apparatuses who work on dry surfaces and near marine areas.

A self contained breathing apparatus ("SCBA") is a device used to enable breathing in environments which are immediately dangerous to life and health (IDLH). For example, firefighters wear an SCBA when fighting a fire. The SCBA typically has a harness supporting an air tank which is connected to a facepiece, all of which are worn or carried by the user. The tank typically contains air or gas under high pressure (2200 psi-4500 psi) and is connected to a first stage regulator which reduces the pressure to about 80 psi. The SCBA usually has a second stage regulator that has an inlet valve which controls the flow of air for breathing between the air tank and the facepiece. Typically, the inlet valve controls the flow of air through the second state regulator in response to the respiration of the user.

Typically, a diaphragm divides the regulator assembly into an inner chamber having a pressure corresponding to the pressure within the facepiece of the SCBA and an outer chamber having a pressure corresponding to the pressure in the surrounding environment, which is typically ambient pressure. The diaphragm is coupled to an actuating mechanism which opens and closes the inlet valve. The user's respiration creates a pressure differential between the inner and outer chambers of the regulator assembly which, in turn, causes displacement of the diaphragm thereby controlling (that is, opening and closing) the inlet valve mechanism. As a result, such regulators are often called pressure demand regulators.

The facepiece of the SCBA is typically maintained at a positive pressure as compared to the surrounding environmental pressure to, for example, prevent toxic gases and vapors in the surrounding environment from entering the facepiece. This positive pressure can, for example, be facilitated by biasing the diaphragm with a spring.

Present harnesses are designed to be worn by the user over the garb. However, there is no allowance for the SCBA pack/harness to be worn over a Coast Guard approved lifejacket, nor is an approved lifejacket large enough to fit over a SCBA pack/harness. Thus, those who work on dry surfaces adjacent to marine environments, such as a boat, dock, or off-shore rig, and who are required to wear a SCBA unit cannot wear an appropriate lifejacket. As a result, the users and employers will be in violation of 46 CFR §185.508 in the very instance that the CFR spells out they are required to wear a lifejacket, "(3) In the event of flooding, fire, or other events that may possibly call for evacuation;" (46 CFR §185.508), which is in reference to when an individual must don a lifejacket.

SUMMARY OF THE INVENTION

This invention, in it's entirety, is the integration of a flotation device (United States Coast Guard approved flotation device or otherwise) onto, into, alongside, with or in-tandem with a SCBA unit, (a self contained breathing apparatus as a whole or by its parts, the pack, shoulder straps, mounting device, tank, etc. or by affixing the flotation device onto any of the previously mentioned SCBA unit or it's parts). The flotation device is intended to support the weight of the user as well as the weight of his or her SCBA unit and its parts. The flotation device is intended to be self inflating, but it may also be rigid. One way of possible integration, in no way the sole method of personal flotation device integration encompassed by this invention, is described below.

DETAILED DESCRIPTION OF THE INVENTION

This invention entails a self contained breathing apparatus, SCBA unit, and or SCBA harness altered or manufactured so that a personal flotation device ("PFD" or "lifejacket") is integrated onto, within or alongside the SCBA unit. In general, the breathing systems that presently compose a SCBA do not float. Depending upon the composition of the compressed air tank, be it carbon fiber, steel or aluminum, the SCBA unit will range from a few pounds positively buoyant, to negatively buoyant, a range which changes as the user consumes the compressed air within the tank.

In the illustrations one method (by no means the exclusive method) of PFD to SCBA integration is displayed. It is described in more detail below.

Figure 1:
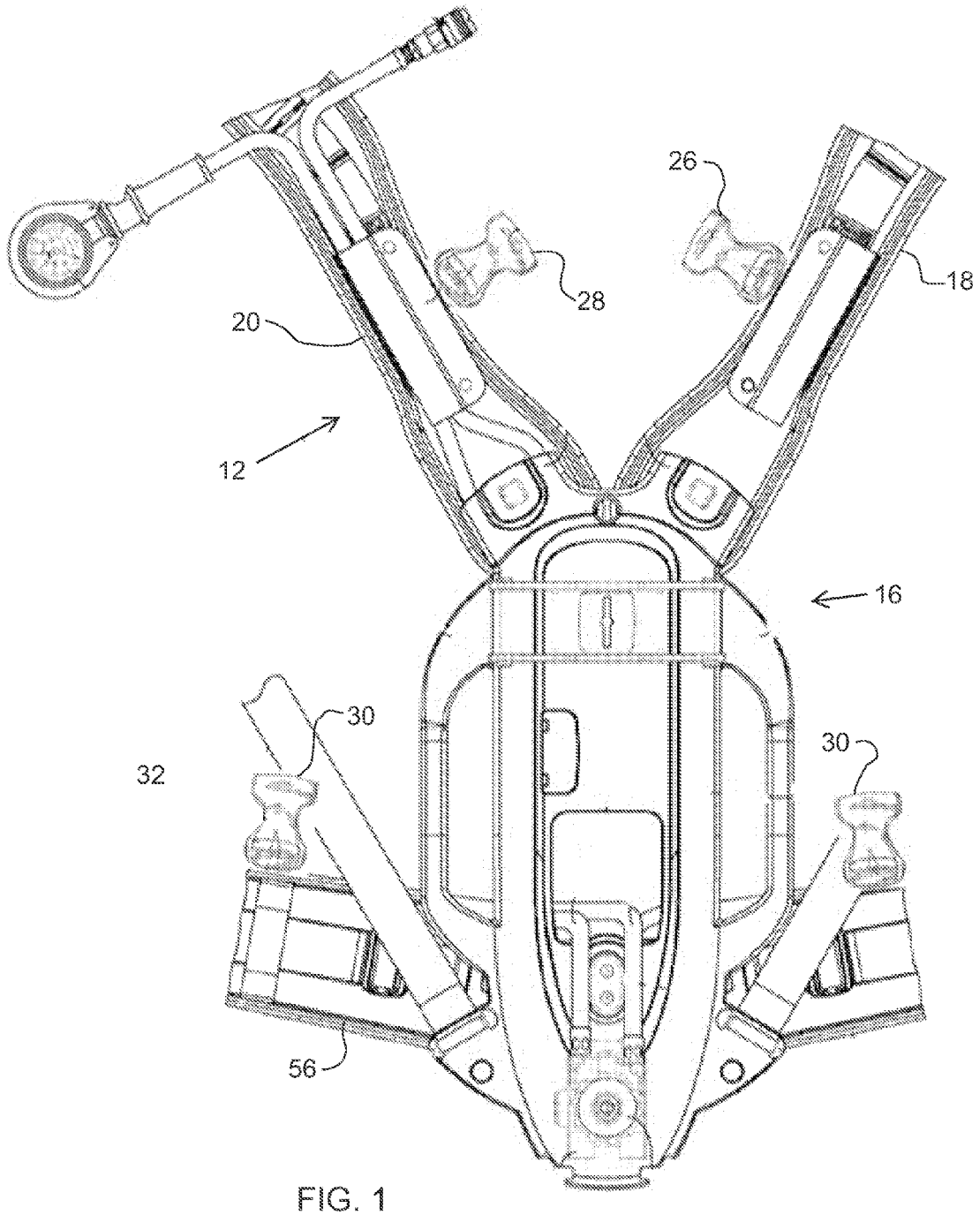
FIG. 1 is a planar view from the back of a SCBA pack (without a compressed air tank). The present invention may be attached to any present day harness (exemplified by FIG. 1) via elements 1-4 which may be any number of attaching devices strong enough to support a sufficient weight, in this case, a buckle is used.
Figure 2:
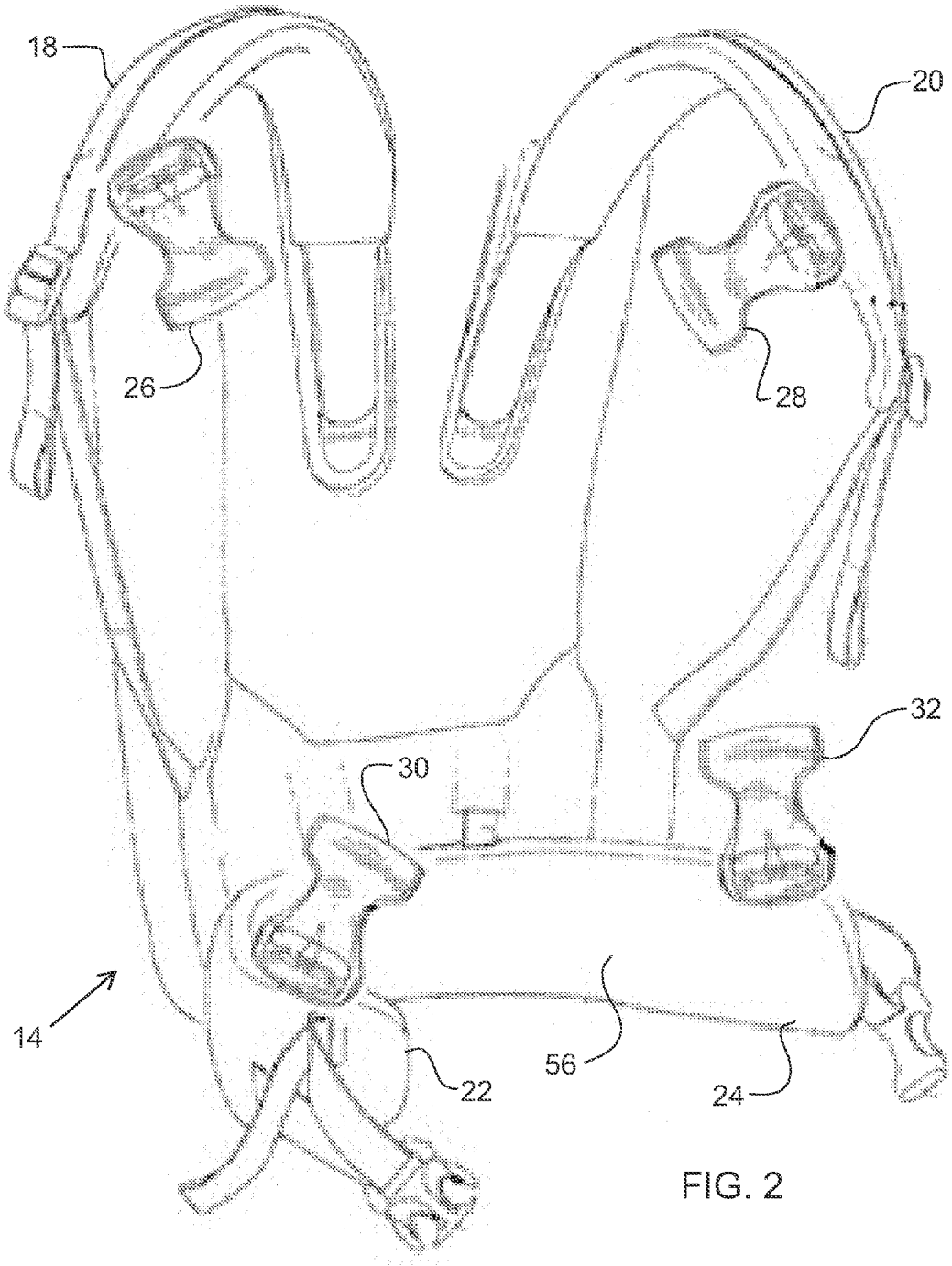
FIG. 2 is a perspective view from the front of a SCBA pack. The present invention may be attached to any present day harness (exemplified by FIG. 2) via elements 1-4 which may be any number of attaching devices strong enough to support a sufficient weight, in this case, a buckle is used.

In FIGS. 1 and 2, the posterior and anterior view of a SCBA pack is shown, respectively. In particular, the posterior side (16) of a standard harness (12) is illustrated. The harness (12) has a right shoulder strap (18) (or right upper portion) and a left should strap (20) (or left upper portion). Attached to the right shoulder strap (18) is the first connector (26); and attached to the left shoulder strap (20) is the second connector (28). A hip belt (56) is configured to wrap about the waste of the user. The hip belt (56) has a right side (22) (or right lower portion) which buckles to a left side (24) (or left lower portion). A third connector (30) is located on the right side (22); and a fourth connector (32) is mounted on the left side (24). The many elements of the SCBA are integrated into a single wearable unit by means of the harness (12).

Figure 3:
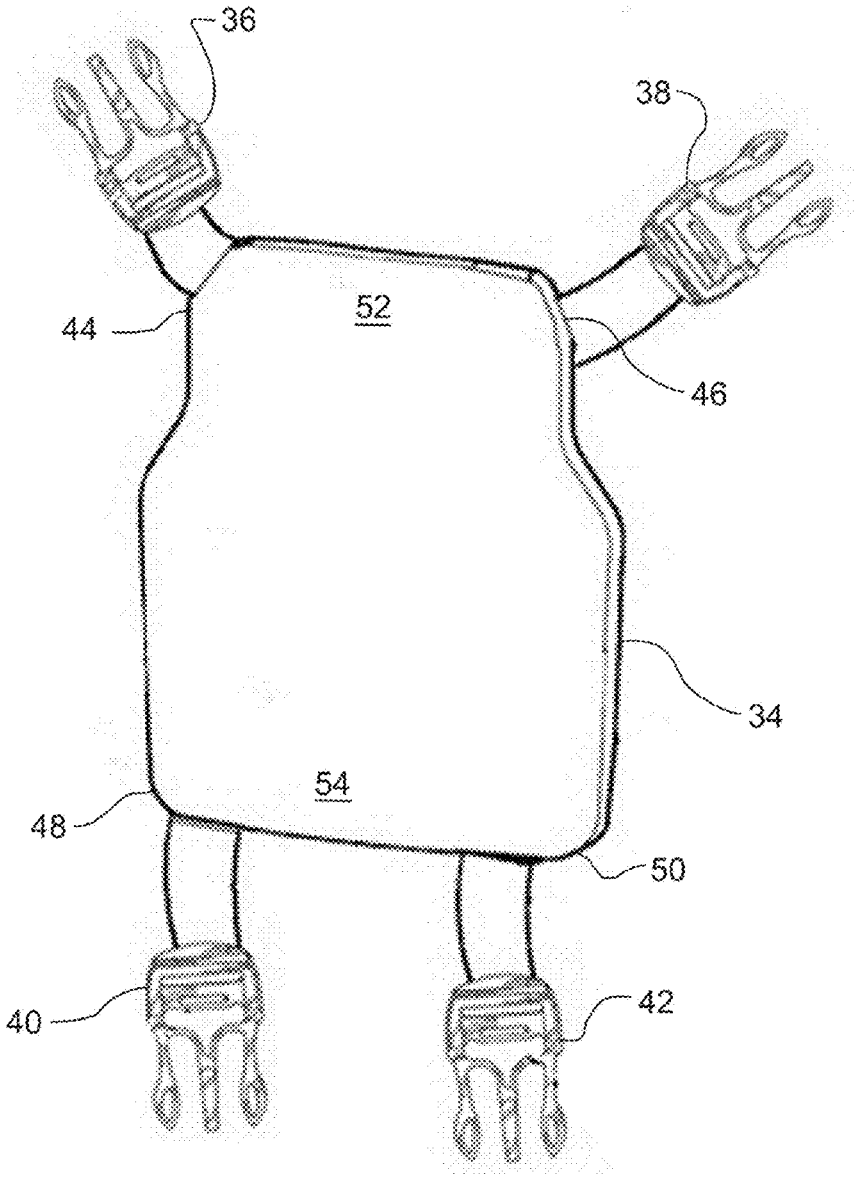
FIG. 3 is a perspective view of the present personal flotation device unit ("PFD" or "Lifejacket") element 5 which attaches to the respective female ends of the buckle connections 1-4 of FIGS. 1 & 2.

FIG. 3 is an example of the flotation device (34) used for this form of integration, which is comprised of a single or multiple, automatically inflating lifejacket unit(s), sewn into a vinyl cover, or like material. On the four corners (40, 42, 44, and 46) of the flotation device (34), there are the buckles, or first mating connector (36), second mating connector (38), third mating connector (40), and fourth mating connector (42) Once the user has donned his or her SCBA, they may take the flotation device (34), e.g., the automatically inflating or rigid PFD, and attach the male end of the buckles (36, 38, 40, and 42) to the respective female buckles (22, 24, 26, and 28) of the SCBA harness, pictured in both FIG. 1 & FIG. 2. Once buckled, the an upper connection (52) is created across the users chest by the first connector (26) being coupled with the first mating connector (36) and the second connector (28) being coupled with the second mating connector (38); and a lower connection (54) is created by the third connector (30) being coupled with the third mating connector (40), and the fourth connector (32) being coupled with the fourth mating connector (42).

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. A self-contained breathing apparatus system comprising:

a harness for supporting an air tank to provide a user with an air supply, the harness having a right upper portion, a left upper portion, a right lower portion, and a left lower portion;

a first connector is positioned on the right upper portion, and a second connector is positioned on the left upper portion;

a third connector is positioned on the right lower portion, and a fourth connector is positioned on the left lower portion; and a floatation unit configured to be strapped over the chest of the user, the floatation unit having a first mating connector near a first corner, a second mating connector near a second corner, a third mating connector near a third corner, and a fourth mating connector near a fourth corner;

wherein the floatation unit is configured to be at least partially removably connected to the harness;

and wherein an upper connection is created across the users chest by the first connector being coupled with the first mating connector and the second connector being coupled with the second mating connector;

and wherein a lower connection is created by the third connector being coupled with the third mating connector, and the fourth connector being coupled with the fourth mating connector;

and wherein the system is configured to be donned over clothing for work on a dry surface.

2. The system of claim 1 wherein the right upper portion is a right shoulder strap, the left upper portion is a left shoulder strap, the first connector is positioned on the right shoulder strap, and the second connector is positioned on the right shoulder strap.

3. The system of claim 1 wherein the harness further comprises a hip belt with a right side and a left side, where the right side is the right lower portion and the left side is the left lower portion, the third connector is positioned on the right side of the hip belt, and the fourth connector is positioned on the left side of the hip belt.

4. The system of claim 1 wherein the floatation unit is inflatable.

5. The system of claim 1 wherein the floatation unit is rigid.

6. The system of claim 1 wherein the floatation unit is removable, such that the user can detach the floatation unit when removed from a nautical environment.

7. The system of claim 1 wherein the first mating connector, the second mating connector, the third mating connector, and the fourth mating connector are each a male squeeze release buckle.

8. The system of claim 7 wherein the first connector, the second connector, the third connector, and the fourth connector are each a female squeeze release buckle.

9. The system of claim 1 wherein the floatation unit is sufficiently buoyant in water to at least support the user, the harness, and the air tank.

10. The system of claim 1 wherein the right upper portion is a right shoulder strap, the left upper portion is a left shoulder strap, the first connector is positioned on the right shoulder strap, and the second connector is positioned on the left shoulder strap.

11. The system of claim 1 wherein the harness further comprises a hip belt with a right side and a left side, where the right side is the right lower portion and the left side is the left lower portion, the third connector is positioned on the right side of the hip belt, and the fourth connector is positioned on the left side of the hip belt.

12. A self-contained breathing apparatus system comprising:

a harness for supporting an air tank to provide a user with an air supply, the harness having an anterior side and a posterior side, the posterior side configured for supporting an air tank, the anterior side having a right upper portion, a left upper portion, a right lower portion, and a left lower portion; and a flotation unit, the floatation unit being connected to the anterior side of the harness, a first portion of the flotation unit being connected to the right upper portion, a second portion of the flotation unit being connected to the left upper portion, a third portion of the flotation unit being connected to the right lower portion, and a fourth portion of the flotation unit being connected to the left lower portion;

wherein the system is configured to be donned over clothing for work on a dry surface; and wherein the flotation unit is removably connected to the anterior side of the harness;

the anterior side of the harness having a first connector positioned on the right upper portion, and a second connector positioned on the left upper portion, a third connector positioned on the right lower portion, and a fourth connector positioned on the left lower portion; and the flotation unit having a first mating connector, a second mating connector, third mating connector, and a fourth mating connector;

wherein an upper connection is created by the first connector being coupled with the first mating connector and the second connector being coupled with the second mating connector; and wherein a lower connection is created by the third connector being coupled with the third mating connector, and the fourth connector being coupled with the fourth mating connector.

13. The system of claim 12 wherein floatation unit configured to be strapped over the chest of the user.

* * * * *